US005558272A

United States Patent [19]

Magister

[11] Patent Number: 5,558,272

[45] Date of Patent: Sep. 24, 1996

[54] OCTAGONAL CONTAINER WITH NOVEL CLOSURE

[75] Inventor: Francis M. Magister, Murrysville, Pa.

[73] Assignee: Victorian Gift Box, Inc.

[21] Appl. No.: 562,029

[22] Filed: Nov. 22, 1995

[51] Int. Cl.[6] ..... B65D 5/64

[52] U.S. Cl. ..... 229/109; 229/116.1; 229/138; 229/922

[58] Field of Search ..... 206/457; 229/109, 229/116.1, 138, 922

[56] References Cited

U.S. PATENT DOCUMENTS

| | | | |
|---|---|---|---|
| 727,723 | 5/1903 | Webb | 229/109 |
| 1,472,211 | 10/1923 | Gallistel | 229/109 |
| 2,013,691 | 9/1935 | Martinson | 229/109 |
| 2,091,291 | 8/1937 | Ringler | 229/109 |
| 3,549,081 | 12/1970 | Nelson | 229/138 |
| 3,799,425 | 3/1974 | Fanter | 229/116.1 |
| 4,201,331 | 5/1980 | Austin | 229/116.1 |
| 4,795,082 | 1/1989 | Fujihara et al. | 229/109 |
| 4,850,528 | 7/1989 | Hanus | 229/138 |
| 4,930,680 | 6/1990 | Hanus | 229/138 |

*Primary Examiner*—Gary E. Elkins

[57] ABSTRACT

An octagonal container formed from a single piece of foldable material which includes a top foldable into a segmented cover which defines upon closing a visually distinct design.

5 Claims, 4 Drawing Sheets

OCTAGONAL CONTAINER WITH NOVEL CLOSURE

FIELD OF THE INVENTION

The present invention relates to an octagonal container and, in particular, to a container having eight sides and a novel closure having multiplanar decoration which is fabricated out of a piece of foldable material.

BACKGROUND OF THE INVENTION

Containers for use in packaging products are well known, including those of configurations other than rectangles or cylinders. Containers are often designed for the unique properties of the items to be packaged as well as for decorative purposes. One such decorative container, is a hexagonical package having six sides and a top closure having a decorative visual configuration in the form of a segmented disk or multi-sided figure projected above the elements of the top closure. This unique container is manufactured from a single sheet of foldable material, normally cardboard or corrugated paperboard.

Containers of this latter type are especially desirable for use as specialty packaging in the gift and specialty wrap industry. Containers of this type provide numerous advantages over other types of decorative containers. Prior to the present invention, however, multi-sided containers having more than six sides with a visually decorative closure lying in planes outside of the closure plane were unknown. Moreover, such containers were not available for fabrication from a single sheet of material.

Accordingly, it is an object of the present invention to provide a novel octagonal container having closure means which includes a visually distinct multiplanar decoration. It is another object of the invention to provide an octagonal container which can be fabricated from a single sheet of foldable material.

SUMMARY OF THE INVENTION

The present invention comprises an octagonal container having eight rectilinear side members where at least one edge of each of the sides is attached to adjacent side member. The container includes eight top members wherein each top member preferably comprises a triangular closure element in which the base of the triangular element is attached to an associated side member. Attached to one of the remaining other sides of the triangular element is a triangular support and a tetrahedron polygon or member, respectively. Eight bottom members comprising four mirrored pairs are used to form the bottom of the container.

Each of the members of the container are formed from a planar sheet of foldable material. In the preferred embodiment the material is a corrugated paperboard or cardboard stock. Other foldable materials such as polyethylene sheets can be used. Further, each of the side, top, and bottom members is preferably defined by a prescribed fold stamped or otherwise positioned to facilitate the folding of the container into its final shape. The bottom member also includes a pain die cut side elements.

By assembling the container of the present invention from a planar of stock material and by prescribing the fold lines, the containers can be shipped in the flat to the destination of packaging. This provides significant savings in transportation and storage, yet affords a novel designed container for the gift and packaging industry. Other advantages of the invention will become apparent from a perusal of the following detailed description of a presently preferred embodiment of the invention taken in connection with the accompanying drawings.

PRESENTLY PREFERRED EMBODIMENT

Figure 1:
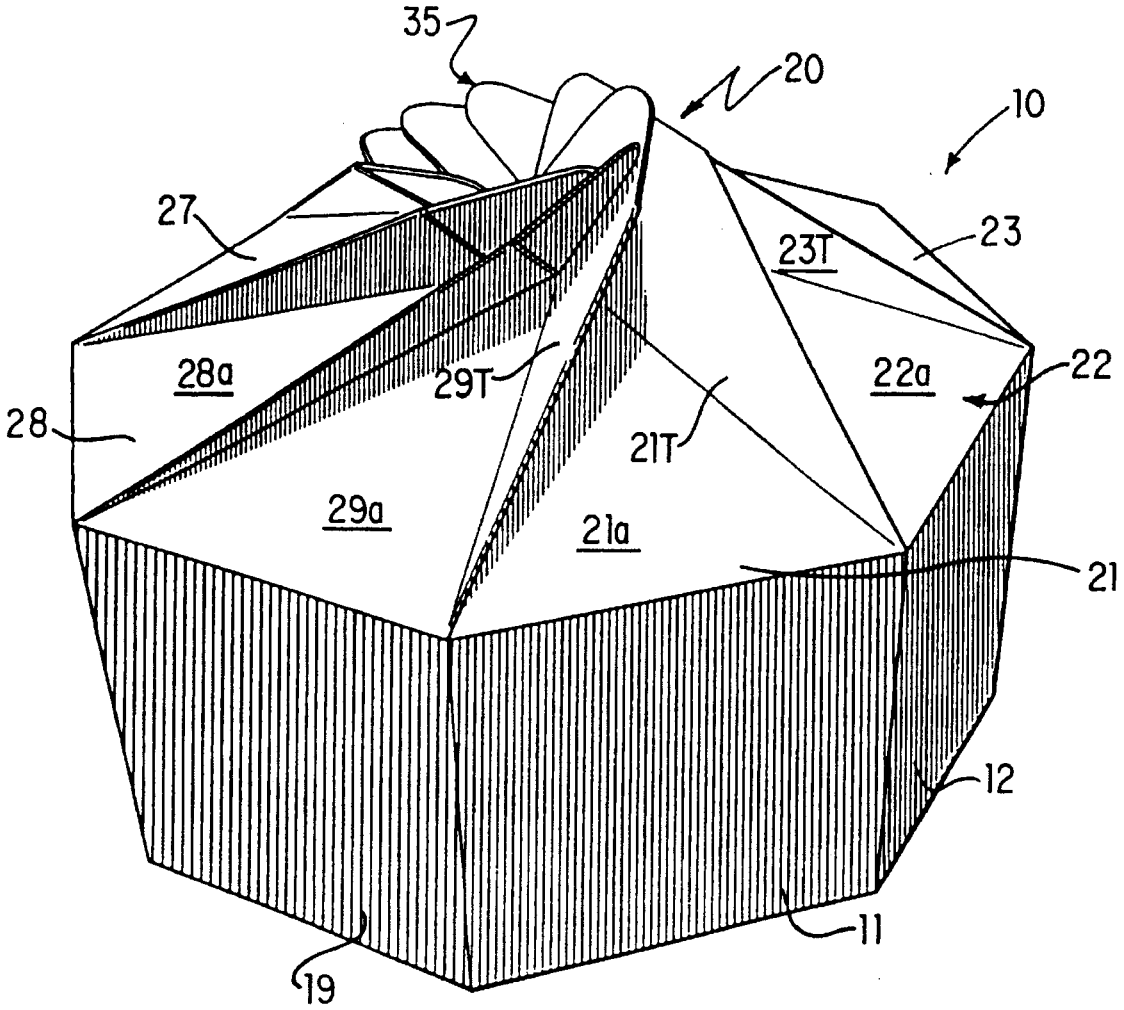
FIG. 1 is a isometric view of the octagonal container of the present invention.
Figure 2:
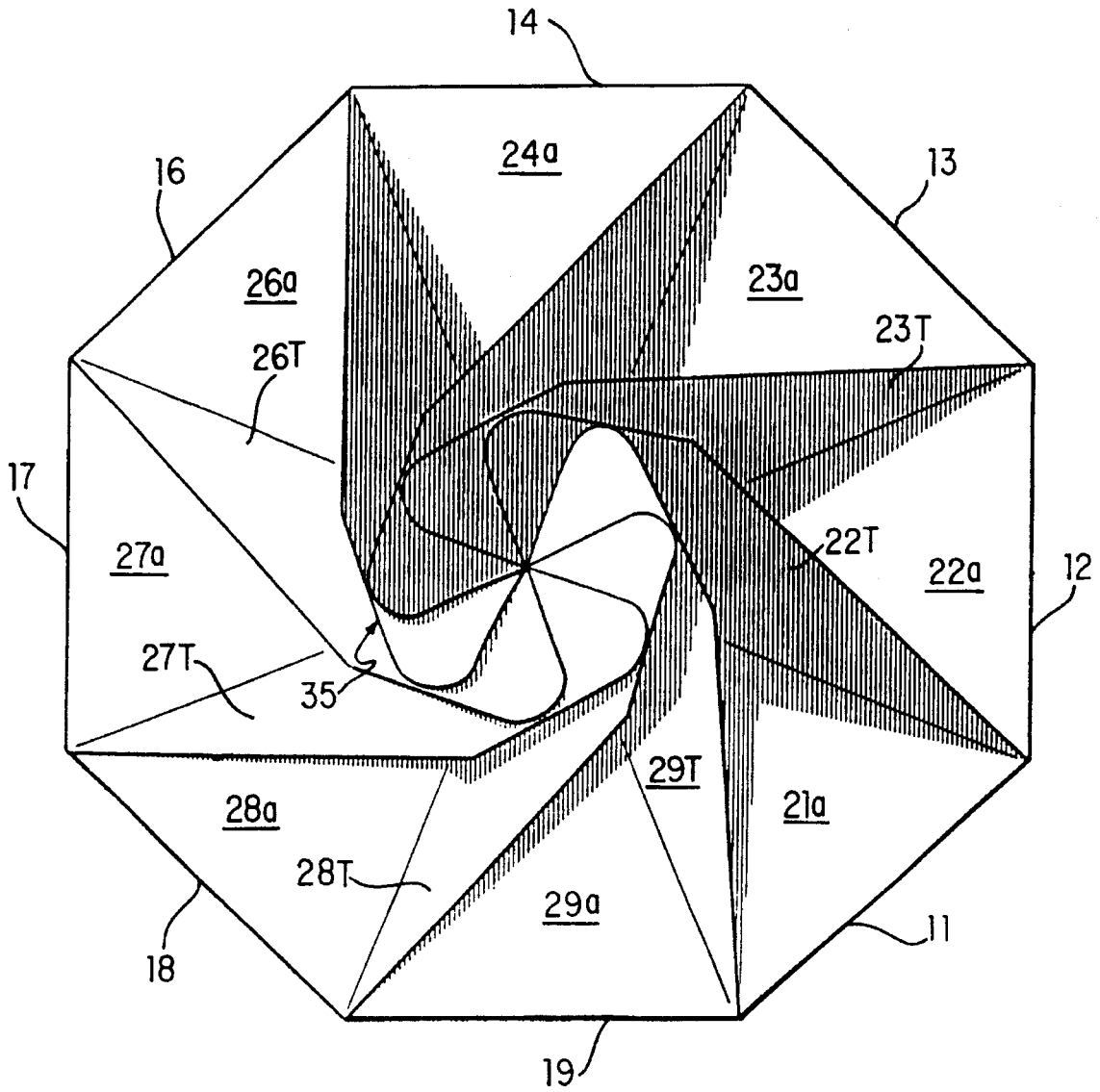
FIG. 2 is a top plan view of the container shown in FIG. 1.

Referring to FIGS. 1 and 2, container 10 comprises eight side members 11–14 and 16–19 having a preferably rectilinear configuration such as a rectangle or square. A closure 20 comprising eight closure members 21–24 and 24–29 each comprising a triangular base element 21*a*–24*a* and 26*a*–29*a*. Triangular closure elements substantially define the top closure for container 10. Each triangular base element includes along one of its radial sides 21*b*–24*b* and 26*b*–29*b* a tetrahedral member 21T–24T and 26T–29T which lies outside the plane of its associated base element. Also, triangular supports 21*c*–24*c* and 26*c*–29*c* are positioned along associated sides 21*d*–24*d* and 26*d*–29*d* (shown in FIG. 3).

Tetrahedral members 21T–24T and 26T–29T each include angle 31–34 and 36–39, respectively, unassociated with the other elements of closure 20. In the preferred embodiment, these angles or outside corners 30 are rounded so that in their final configuration form a visually distinctive pattern of a bow 35 as seen in the FIG. 2, plan view. However, as can be seen from FIG. 1 all of the members 21T–24T and 26T–29T lie in a different plane.

Figure 3:
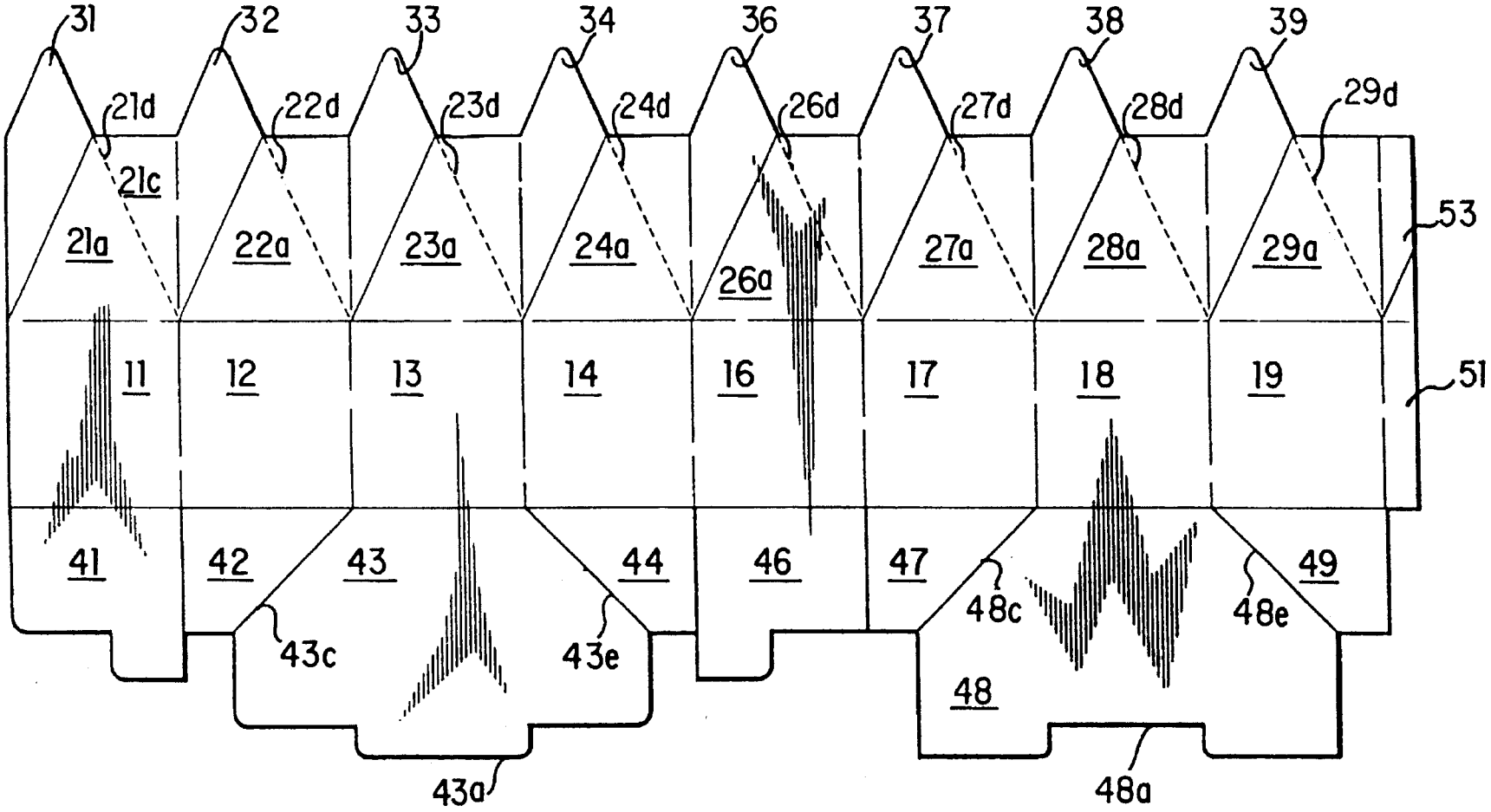
FIG. 3 is a plan view of a single sheet of stock material showing the cuts and fold lines for fabrication of the container shown in FIG. 1.
Figure 4:
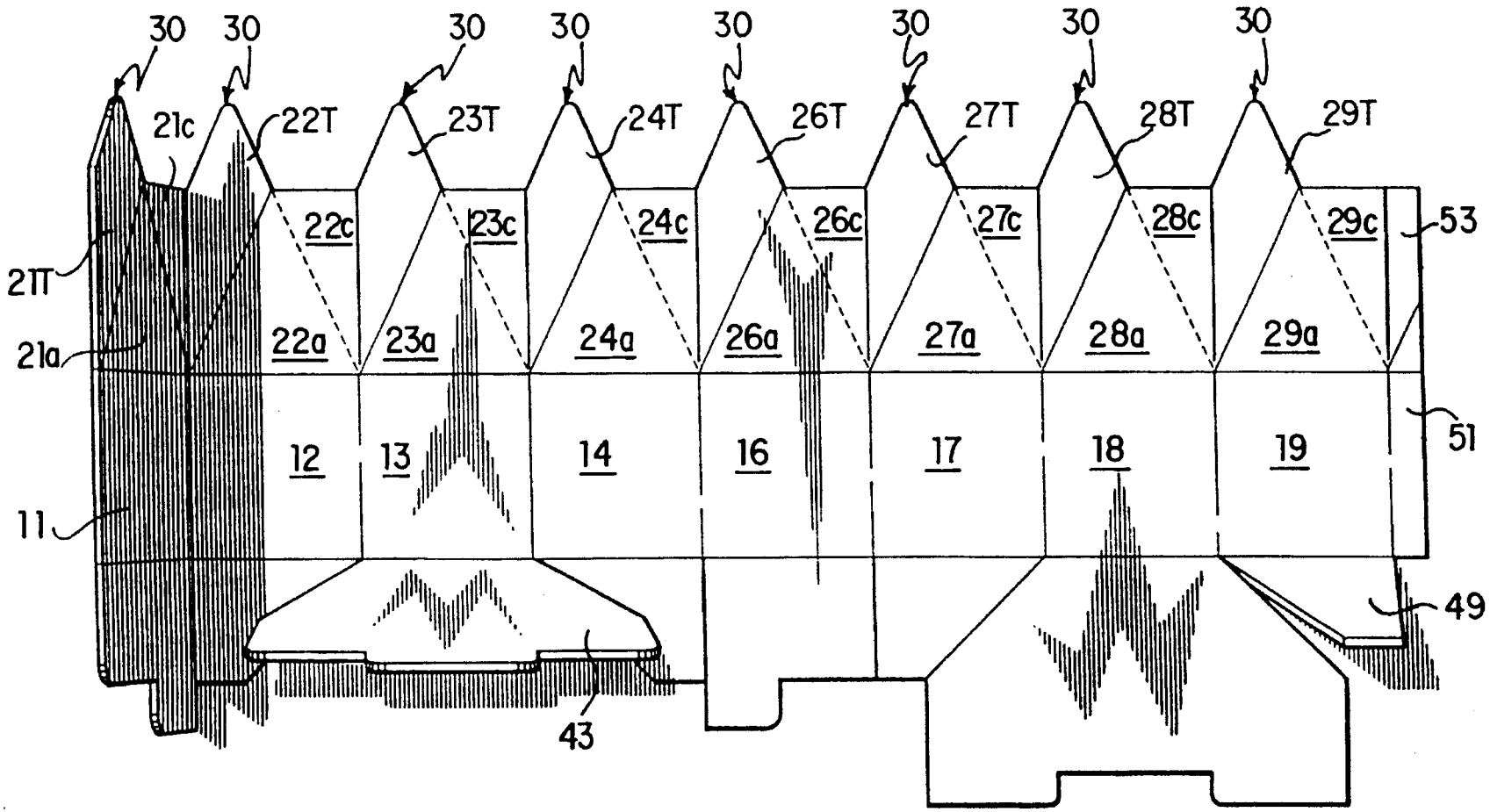
FIG. 4 is a perspective view of a number of folds on the stock shown in FIG. 3.

Referring to FIGS. 3 and 4, a single sheet 40 of foldable material is shown cut, preferably die cut, and fold press lines included. As shown in FIG. 3, bottom closure members 41–44 and 46–49 are shown. In this embodiment, members 43 and 48 comprise the principal bottom closure members. Member 43 includes projecting tab 43*a* and member 48 includes recess 48*a* to accept tab 43*a* during folding. As can be seen from FIG. 4, members 43 and 48 also include respective sides 43*c* and 43*e* and 48*c* and 48*e* which are die cut to accommodate interleaf folding to form a bottom closure. As illustrated in FIG. 3, members 41 and 46 are mirror images of each other and members 42 and 47 are identical to one another as are members 44 and 49.

As shown in FIG. 3, side members 11–14 and 16–19 are associated with tetrahedonal members 21T–24T and 26T–29T as well as closure members 41–44 and 46–49, respectively. Sides 21*d*–24*d* and 26*d*–29*d* are shown in dotted lines to reflect the fact that these comprise reverse folds from sides 21*b*–24*b* and 26*b*–29*b*. Also shown in FIG. 3, elements 51 and 52 which comprise extension for adhesives or a land surface for other mounting means such as staples or the like to secure side member 21*a* to 29*a* and top member 21*b* to 52, respectively. As is apparent to one skilled in the art, the container of the present invention provides a distinctively designed container for girls and the like which is easy to assemble and ship. The size of the various members can be adjusted to accommodate the needs of the ultimate user while the configuration of corners 30 is shown as rounded to present the visual effect of bow 35; it may be otherwise configured to present other visual effects.

Thus, while presently preferred embodiment of the invention has been shown and described in detail, the invention may otherwise be embodied within the scope of the appended claims.

What is claimed is:

1. An octagonal container comprising:

a. eight rectilinear side members, each of said side members being attached to at least one other side member;

b. eight top members each attached to at least one other top member and associated with one of said side members; each of said top members comprising a triangular top element, the base of which is attached to said associated side member, each of said triangular top elements including at least a tetrahedrahedral element on one of its other sides and a triangular support element on its remaining side; and c. eight closure members, each of said closure members being associated with a side member and having complimentary shapes with at least one other closure member to interleaf together to define a bottom closure for said container wherein said container is formed from a planar sheet of foldable material.

2. An octagonal container as set forth in claim 1 wherein said closure members comprise four pairs of complimentary elements, one of said pairs including elements which have a tab and corresponding recess to lock said elements together for a substantial portion of said closure.

3. An octagonal container as set forth in claim 1 or 2 wherein said at least a tetrahedrahedral element is a polygon.

4. An octagonal container as set forth in claim 1, 2 or 3 wherein said side members are either a rectangle or a square.

5. An octagonal container as set forth in claim 1 or 2 wherein said at least a tetrahedrahedral element is in a plane different from said triangular top element.

* * * * *